US009466868B2

(12) United States Patent
Ding et al.

(10) Patent No.: US 9,466,868 B2
(45) Date of Patent: Oct. 11, 2016

(54) RECONFIGURABLE BRANCH LINE COUPLER

(71) Applicant: INTERNATIONAL BUSINESS MACHINES CORPORATION, Armonk, NY (US)

(72) Inventors: Hanyi Ding, Colchester, VT (US); Alberto Valdes Garcia, Hartsdale, NY (US); Wayne H. Woods, Jr., Burlington, VT (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 23 days.

(21) Appl. No.: 14/257,464

(22) Filed: Apr. 21, 2014

(65) Prior Publication Data

US 2015/0303548 A1 Oct. 22, 2015

(51) Int. Cl.
*H01P 5/04* (2006.01)
*H01P 5/22* (2006.01)
*H01P 5/12* (2006.01)

(52) U.S. Cl.
CPC ..... *H01P 5/227* (2013.01); *H01P 5/04* (2013.01)

(58) Field of Classification Search
CPC ..... H01P 5/18; H01P 5/184; H01P 5/185; H01P 1/184
USPC ..... 333/109–112, 116, 117, 161
See application file for complete search history.

(56) References Cited

U.S. PATENT DOCUMENTS 5,455,545 A 10/1995 Garcia
6,335,662 B1 1/2002 Del Rosario, Jr. et al.
7,084,717 B2 * 8/2006 Okazaki et al. ..... 333/118
7,538,635 B2 * 5/2009 Fukuda et al. ..... 333/117
7,639,102 B2 12/2009 Wagner et al.
2010/0001781 A1 1/2010 Ulian
2011/0273244 A1 * 11/2011 Iluz ..... 333/161

FOREIGN PATENT DOCUMENTS

WO 0024079 A1 4/2000

OTHER PUBLICATIONS

Leong, et al., "A Tunable Dual-Band DGS Stub Tapped Branch-Line Coupler", Proceedings of Asia-Pacific Microwave Conference, 2010, 4 pages.
Scheeler, et al., "GaAs MMIC Tunable Directional Coupler", IEEE, 2012, 3 pages.
Ferrero, et al., "Compact Quasi-lumped Hybrid Coupler Tunable Over Large Frequency Band", Electronics Letters, Sep. 2007, vol. 43, No. 19, 2 pages.
Zheng, et al., "Reconfigurable RF Quadrature Patch Hybrid Coupler", IEEE, Aug. 2013, vol. 60, No. 8, pp. 3349-3359.
(Continued)

*Primary Examiner* — Dean Takaoka
(74) *Attorney, Agent, or Firm* — David Cain; Andrew M. Calderon; Roberts Mlotkowski Safran Cole & Calderon P.C.

(57) ABSTRACT

A reconfigurable branch line coupler and methods of designing and reconfiguring the branch line coupler are disclosed. The reconfigurable branch line coupler includes a plurality of transmission lines, each of which comprises a phase shifter. The reconfigurable branch line coupler further includes an input port, which is split into two quadrature signals providing a second and third port between adjacent of the plurality of transmission lines, with a fourth port isolated from the input port at a center frequency.

18 Claims, 9 Drawing Sheets

(56) References Cited

OTHER PUBLICATIONS

Mextorf, et al., "Systematic Design of Reconfigurable Quadrature Directional Couplers", IEEE, 2009, pp. 1009-1012.
Fardin, et al., "Electronically Tunable Lumped Element 90° Hybrid Coupler", Electronics Letters, Mar. 2006, vol. 42, No. 6, 2 pages.
Djoumessi, et al., "Varactor-Tuned Dual-Band Quadrature Hybrid Coupler", IEEE, Nov. 2006, vol. 16, No. 11, pp. 603-605.
Fardin, et al., "Frequency Agile 90° Hybrid Coupler Using Barium Strontium Titanate Varactors", IEEE, 2007, pp. 675-678.
Kondo, et al. "A Reduced-Size and Tunable Branch-Line 3dB Hybrid", Microwave Conference Proceedings (APMC), Dec. 2011, Abstract.
Woods et al., "CMOS Millimeter Wave Phase Shifter Based on Tunable Transmission Lines", IEEE, 2013, 4 pages.
Specification and Drawings for U.S. Appl. No. 13/867,433, filed Apr. 22, 2013, 32 pages.
Specification and Drawings for U.S. Appl. No. 13/867,422, filed Apr. 22, 2013, 32 pages.

* cited by examiner

RECONFIGURABLE BRANCH LINE COUPLER

FIELD OF THE INVENTION

The invention relates to semiconductor structures and, more particularly, to a reconfigurable branch line coupler and methods of designing and reconfiguring the branch line coupler.

BACKGROUND

A branch line coupler is the simplest type of quadrature coupler, since the circuitry is entirely planar. In a typical branch line coupler, two parallel transmission lines are connected together with two other parallel transmission lines. The transmission lines are λ/4 long and have two distinct characteristic impedances. A signal entering the port 1 is split into two quadrature signals on the ports 2 and 3, with the remaining port 4 fully isolated from the input port at the center frequency.

Branch line couplers usually do not have such a wide bandwidth and are constrained by their designed frequencies. As to the latter point, a branch line coupler has a single frequency, which can be used with a single device. To accommodate different frequency devices, it is necessary to use a differently designed branch line coupler. Accordingly, large chip area needs to be used to accommodate different operating frequencies.

SUMMARY

In an aspect of the invention, a reconfigurable branch line coupler comprises a plurality of transmission lines, each of which comprises a phase shifter. The reconfigurable branch line coupler further comprises an input port, which is split into two quadrature signals providing a second and third port between adjacent of the plurality of transmission lines, with a fourth port isolated from the input port at a center frequency.

In an aspect of the invention, a reconfigurable branch line coupler comprises: a plurality of transmission lines coupled to one another, the plurality of transmission lines comprising: a first transmission line having a characteristic impedance of Zo_B; a second transmission line having a characteristic impedance of Zo_A; a third transmission line having a characteristic impedance of Zo_B; and a fourth transmission line having characteristic impedance of Zo_A; and a phase shifter provided in each of the plurality of transmission lines, the phase shifter in each of the plurality of transmission lines being structured to maintain a constant characteristic impedance of Zo_B and Zo_A while changing a frequency in each of the plurality of transmission lines.

In an aspect of the invention, a method of reconfiguring a branch line coupler comprises determining initial characteristic impedance Zo_A and Zo_B for a specific frequency for each transmission line of the branch line coupler. The method further comprises adjusting capacitance and inductance, at the same time and same rate, taking into consideration w_scan, ws_scan, s_scan, w_ret, capacitance (high/low) and inductance (high/low), with the following approximations: %_change_l (Zo_A)=%_change_l (Zo_B); (ii) %_change_c (Zo_A)=%_change_c (Zo_B); (iii) 0.707*Zo_high (Zo_A)=Zo_high (Zo_B); and (iv) 0.707*Zo_low (Zo_A)=Zo_low (Zo_B).

In another aspect of the invention, a design structure tangibly embodied in a machine readable storage medium for designing, manufacturing, or testing an integrated circuit is provided. The design structure comprises the structures of the present invention. In further embodiments, a hardware description language (HDL) design structure encoded on a machine-readable data storage medium comprises elements that when processed in a computer-aided design system generates a machine-executable representation of the reconfigurable branch line coupler, which comprises the structures of the present invention. In still further embodiments, a method in a computer-aided design system is provided for generating a functional design model of the reconfigurable branch line coupler. The method comprises generating a functional representation of the structural elements of the reconfigurable branch line coupler.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The invention relates to semiconductor structures and, more particularly, to a reconfigurable branch line coupler and methods of designing and reconfiguring the branch line coupler. More specifically, the present invention is directed to a device and method that allows simple, robust reconfigurability of an on-chip Millimeter Wave (MMW) branch line coupler. In embodiments, the MMW branch line coupler includes arms (transmission lines) which each include a phase shifter (with discrete sections) making it possible to change the operating frequencies of the branch line coupler by a large factor, e.g., of about 3X, in controlled linear steps. For example, the branch line coupler can be reconfigured by (i) adjusting the characteristic impedance of the phase shifter on a first transmission line to equal the sqrt(2) times the characteristic impedance of the phase shifter on a second transmission line such that (ii) the transmission lines of the branch line coupler change frequencies by exactly the same factor. Accordingly, it is now possible to switch Zo-0.707*Zo and 0.707*Zo->Zo.

Advantageously, the branch line coupler of the present invention can change frequency significantly such that only a single device is used on a chip for different operating frequencies. This not only provides a considerable savings in chip area, but also allows large area circuit components to be re-used at different operating conditions and frequencies. Moreover, the branch line coupler of the present invention can combat processing variation by, for example, adjusting the delays, Zo (impedance), etc. In embodiments, for example, the branch line coupler can also maintain a constant delay and vary Zo or vice versa. Further, with the branch line coupler of the present invention, it is possible to implement a direct conversion Rx (receiving) and Tx (transmitting) with wide band.

The branch line coupler of the present invention can be manufactured in a number of ways using a number of different tools. In general, though, the methodologies and tools are used to form structures with dimensions in the micrometer or nanometer scale. The methodologies, i.e., technologies, employed to manufacture the reconfigurable branch line coupler of the present invention have been adopted from integrated circuit (IC) technology. For example, the structures of the present invention are built on wafers and are realized in films of material patterned by photolithographic processes on the top of a wafer. In particular, the fabrication of the branch line coupler of the present invention uses three basic building blocks: (i) deposition of thin films of material on a substrate, (ii) applying a patterned mask on top of the films by photolithographic imaging, and (iii) etching the films selectively to the mask.

Figure 1:
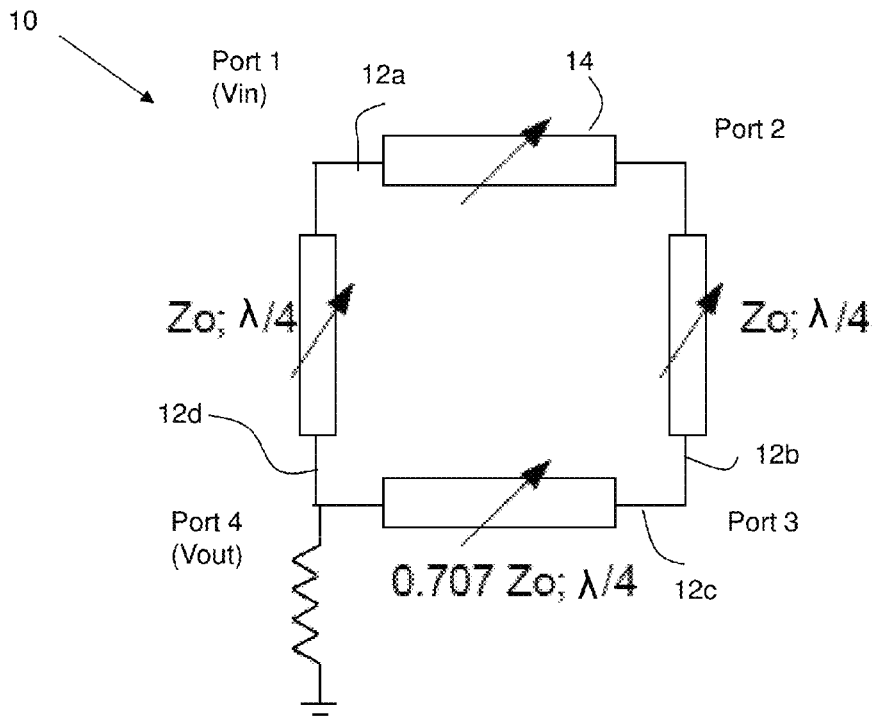
FIG. 1 shows a branch line coupler in accordance with aspects of the present invention.

FIG. 1 shows a branch line coupler in accordance with aspects of the present invention. In embodiments, the branch line coupler 10 includes a plurality of transmission lines (arms) 12*a*, 12*b*, 12*c* and 12*d*, each of which comprises a phase shifter 14. As shown in FIG. 1, each transmission line 12*a*, 12*b*, 12*c* and 12*d* is preferably a quarter wavelength. The branch line coupler 10 further includes port 1, which is split into two quadrature signals, e.g., ports 2 and 3, with the remaining port 4 fully isolated from the input port at the center frequency.

In embodiments, the phase shifters 14 have controllable inductance and controllable capacitance, where the characteristic impedance of a section can vary the phase shift without significantly affecting the constant characteristic impedance, Zo, of the branch line coupler 10. Accordingly, the phase shifters 14 are structured such that the branch line coupler 10 can maintain a constant Zo while changing the operating frequency up to, e.g., about 3X. On the other hand, by using the phase shifters 14, the branch line coupler 10 can maintain a constant operating frequency while varying Zo.

Figure 2:
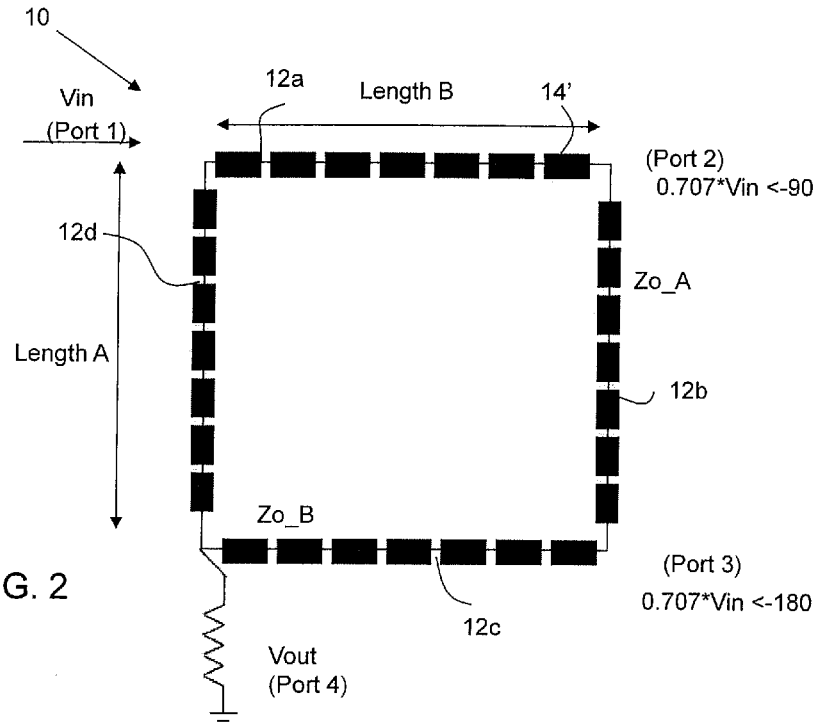
FIG. 2 shows a branch line coupler with discrete sections of a phase shifter on each transmission line, in accordance with aspects of the present invention.

FIG. 2 shows the branch line coupler 10 with discrete sections of a phase shifter on each transmission line, in accordance with the present invention. More specifically, each transmission line 12*a*, 12*b*, 12*c* and 12*d* of the branch line coupler 10 includes seven discrete sections 14' of a phase shifter in accordance with present invention. This structure allows eight (8) discrete incremental steps to adjust frequency of the branch line coupler 10, e.g., between about 30 GHz and 60 GHz; although other operating frequencies and stepped increments are contemplated by the present invention. In embodiments, each discrete section 14' has two capacitance states and two inductance states, thereby being structured to have at least four permutations: (i) capacitance high, inductance high; (ii) capacitance high, inductance low; (iii) capacitance low, inductance high; and (iv) capacitance low, inductance low. The example of the discrete sections 14' of a phase shifter provides frequency change between f_high and f_low.

In operation, any combination of the discrete sections 14' in each transmission line 12*a*, 12*b*, 12*c* and 12*d* is structured to be switched to incrementally adjust the delay or characteristic impedance, Zo. In this way, by switching discrete sections 14' of the phase shifter, the inductance (L) and capacitance (C) can be adjusted high or low, while maintaining the same characteristic impedance, Zo, for a transmission line. That is, the reconfigurable branch line coupler can maintain constant characteristic impedance while changing delay in unison by a same ratio/percentage with the correct Zo_A and Zo_B ratio to ensure acceptable branch line performance. By way of example, the branch line coupler 10 can be reconfigured by adjusting characteristic impedance of the phase shifter on transmission lines by a factor of sqrt(2) times an original characteristic impedance of the transmission lines. In a more specific example, the branch line coupler 10 can be reconfigured by adjusting the characteristic impedance of the phase shifter on a first transmission line to equal the sqrt(2) times the characteristic impedance of the phase shifter on a second transmission line; whereas, the characteristic impedance of the phase shifter of the second transmission line is adjusted to 1/sqrt(2) times the characteristic impedance of the phase shifter on the first transmission line.

Advantageously, by using the discrete sections 14' of the phase shifter, it is now possible to use the branch line coupler 10 for different frequency ranges, and hence allows large area circuit components to be reused at different operating frequencies without the need for different devices. So, for example, the branch line coupler 10 of the present invention can provide both 30 GHz and 60 GHz desired input and output characteristics of a circuit component.

Figure 3:
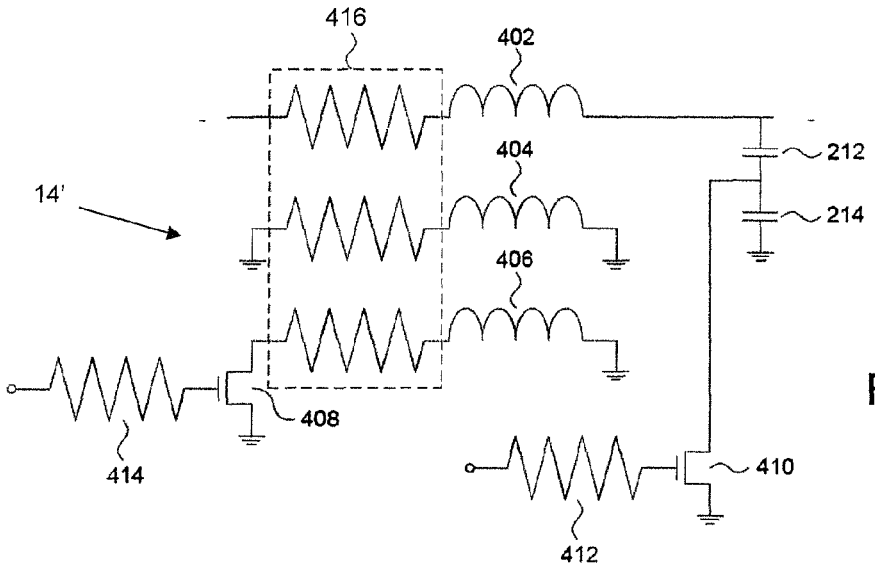
FIG. 3 is a schematic representation of a discrete section of a phase shifter in accordance with aspects of the present invention.

FIG. 3 is a schematic representation of a discrete section 14' of a phase shifter in accordance with aspects of the present invention. A detailed discussion of the phase shifter and its constituent components/sections is provided in U.S. application Ser. Nos. 13/867,433 and 13/867,422, the contents of which are incorporated by reference herein in their entirety. It should be understood by those of skill in the art that other phase shifters are also contemplated for use in the present invention.

In the circuit model of FIG. 3, each section 14' of the phase shifter includes switches 408 and 410 used to control inductance, capacitance and delay. The switches can be, for example, FETs, pin diodes, bipolar junction transistor (BJTs) or Heterojunction Bipolar Transistor (HBTs), amongst others. The capacitance 212 and 214 are representative of signal to crossing line capacitance and crossing line to ground capacitance (see, e.g., FIG. 6), which are connected by switch 410. In embodiments, each section 14' of the phase shifter further includes three inductance lines 402, 404 and 406 in series with a line resistance 416. Resistors 416 represent the inherent resistances of the signal, ground, and inductance return lines and can be determined by their materials and geometries. The inductance lines 402, 404 and 406 represent, respectively, a self inductance of a signal line, a self inductance of ground lines and self inductance of a conditional inductance line, respectively. Coupling inductances exist between these lines, with a mutual inductance between the signal line and the inductance return line, a mutual inductance between the signal line and the ground lines, and a mutual inductance between the ground lines and the inductance return line. The switch (e.g., FET) 410 controls the tunable effective signal line capacitance. Resistors 412 and 414 represent resistances that correspond to the isolation resistors used at the inputs of switches 410 and 408, respectively, e.g., 10k ohms.

Figure 4:
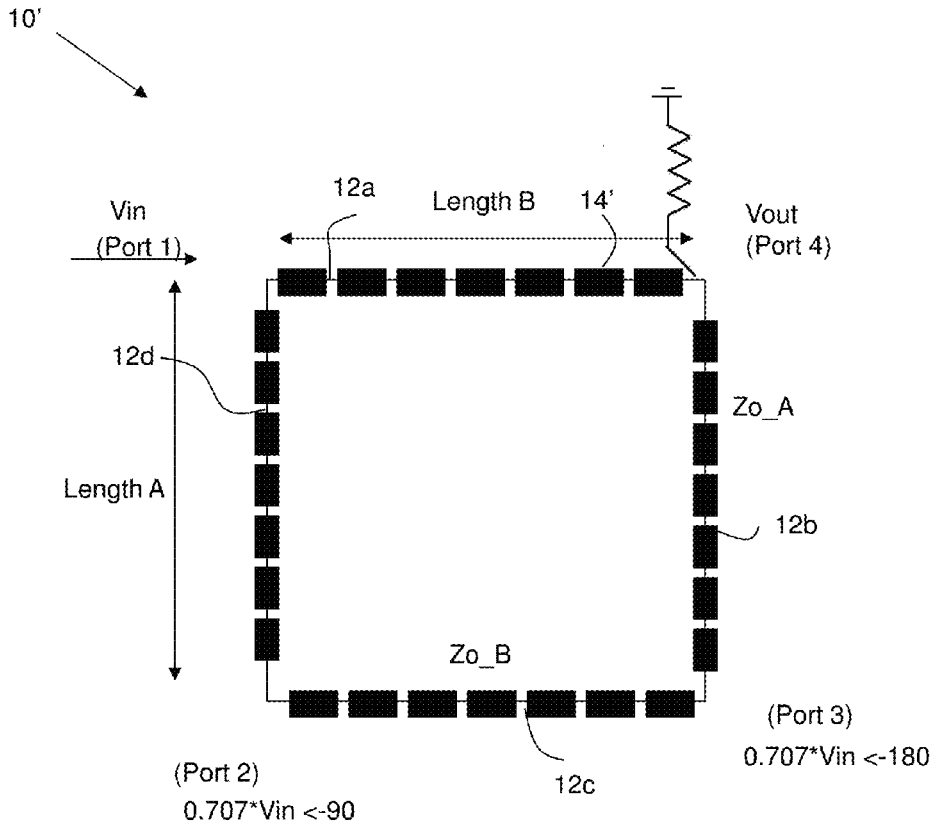
FIG. 4 shows a branch line coupler with a swapped output port, in accordance with the aspects of the present invention.

FIG. 4 shows a branch line coupler with a swapped output port, in accordance with the present invention. More specifically, FIG. 4 shows a branch line coupler 10' with a swapped Vout (port 4). In embodiments, the swap is effectuated by changing the characteristic impedance Zo_A of transmission lines 12*b*, 12*d* and characteristic impedance Zo_B of transmission lines 12*a* and 12*c*, using the discrete sections 14' of the phase shifters on each transmission line. More specifically, characteristic impedance can be changed as follows:

(i) characteristic impedance Zo_A new=Zo_B old (FIG. 2); and (ii) characteristic impedance Zo_B new=Zo_A old (FIG. 2).

Also, in implementation, the delay in the swapped transmission lines 12*a*, 12*b*, 12*c* and 12*d* can remain the same.

In embodiments, the swapping can be accomplished by independently changing the inductance high and capacitance low, or vice versa, in order to match a desired frequency. Also, in embodiments, the branch line coupler 10' can be reconfigured on the fly to output to a different port, thereby being capable of being used as a switch. This implementation can be useful for power monitoring or for designs where small size is critical.

By way of more specific illustrative example, for a port swap mode, the following can be assumed:

sqrt(L_high_B/C_low$_{_B}$)~sqrt(2)*sqrt(L_low_B/C_low$_{_B}$)=sqrt(2)* Zo_B~Zo_A;

sqrt(C_low_B*L_high_B)~sqrt(2)*sqrt(C_low_B*L_low_B)~sqrt(2)*delay_B_fast;

sqrt(L_low_A/C_high_A)~(1/sqrt(2))*sqrt(L_low_A/C_low_A)=(1/sqrt(2))*Zo_A~Zo_B; and sqrt(C_high_A*L_low_A)~sqrt(2)*sqrt(C_low_A*L_low_A)~sqrt(2)*delay_A_fast.

It should be understood that reference letters "A" and "B" represent transmission lines of length "A" and length "B", respectively, reference letter "C" represents capacitance and reference letter "L" represents inductance.

In a normal frequency changing operation:

Let X=delay_B_fast, then, for 3-bit, 8 states of delay for "transmission line" B as follows:

[X, 1.143X, 1.286X, 1.429X, 1.571X, 1.714X, 1.857X, 2X]

By providing a swap mode, the branch line coupler 10' can now be used as a switch due to the significant change in frequency, e.g., 1.429X which is ~1.414X~sqrt(2) X=sqrt(2)*delay_B_fast. Also, by implementing the processes and structures of the present invention, it is also noted that each transmission line can have both fine and course tuning segments, e.g., 10%-20% of the arm delay, Zo, etc., by incrementally switching the discrete sections of the phase shifter in some combination. This can thus be used for combating process variations and fine tuning for improved accuracy.

Figure 5:
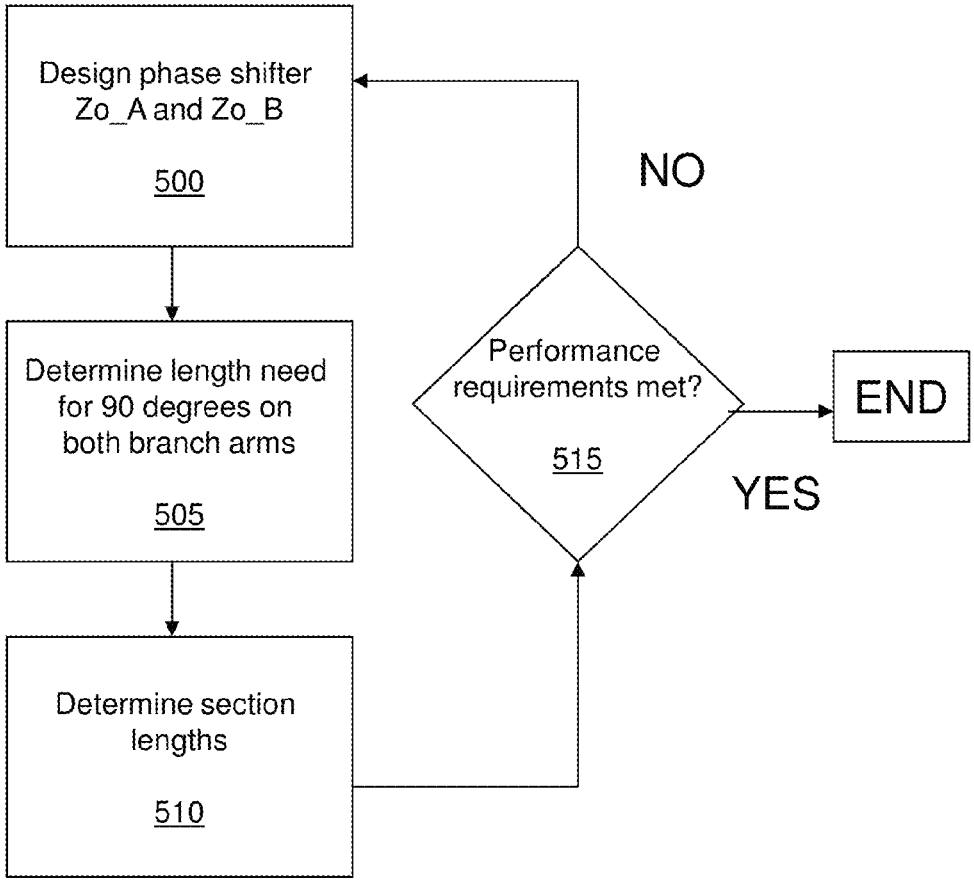
FIG. 5 shows a method of designing a reconfigurable branch line coupler in accordance with aspects of the present invention.

FIG. 5 shows a flowchart for designing a reconfigurable branch line coupler of the present invention. The flowchart of FIG. 5 illustrates the architecture, functionality, and operation of possible implementations of systems, methods, and computer program products according to various embodiments of the present invention. In this regard, each block in the flowchart may represent a module, segment, or portion of instructions, which comprises one or more executable instructions for implementing the specified logical function(s).

The flow can be implemented in any known computing infrastructure, using, for example, computer readable storage medium. For example, the computing infrastructure can be a computing device resident on a network infrastructure or computing device of a third party service provider. The computing device includes a processor (e.g., CPU), memory, an I/O interface, and a bus. The memory can include local memory employed during actual execution of program code, bulk storage, and cache memories which provide temporary storage of at least some program code in order to reduce the number of times code must be retrieved from bulk storage during execution. In addition, the computing device includes random access memory (RAM), a read-only memory (ROM), and an operating system (O/S). The computing device is in communication with external I/O device/resource and storage system. In general, processor executes computer program code (e.g., program control), which can be stored in memory and/or storage system. Moreover, in accordance with aspects of the invention, program control controls the processes described herein.

Computer readable storage medium can be a tangible device that can retain and store instructions for use by an instruction execution device, e.g., computing infrastructure. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Referring to FIG. 5, at step 500, any known automated method (see, e.g., FIG. 9 and the description thereof) is used to design the characteristic impedance Zo_A and Zo_B. In particular, the automated method designs the characteristic impedance Zo_A and Zo_B for a specific frequency and desired frequency change factor, e.g., 2X or 3X. At step 505, the process of the present invention determines a length needed for 90 degrees on both branch arms, e.g., transmission lines (length A and length B). At step 510, the process of the present invention determines section lengths of each discrete section of the phase shifter. In embodiments, the section length is determined by the length of the transmission line divided by the number of sections, e.g., (length A)/(# of sections). At step 515, a determination is made as to whether all performance requirements are met, e.g., phase change, worse case loss, etc. If so, then the process ends. If not, the process reverts to step 500.

Figure 6:
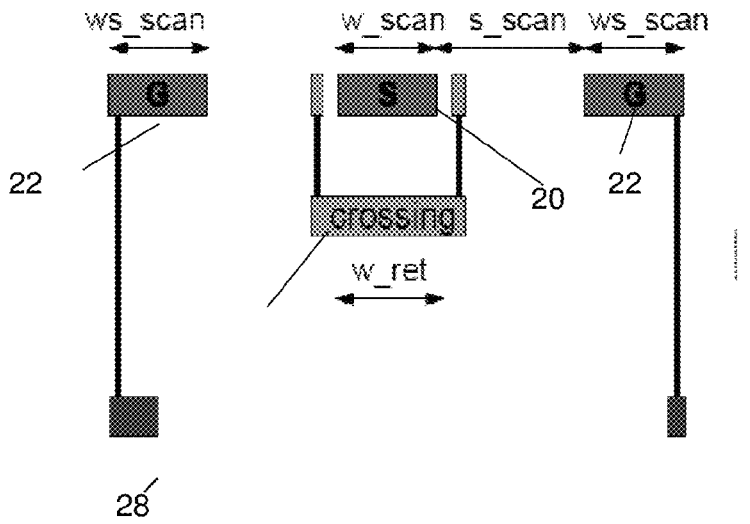
FIG. 6 shows an example cross sectional view of a transmission line of a branch line coupler in accordance with aspects of the present invention.

FIG. 6 shows an example cross sectional view of a transmission line of a branch line coupler for adjusting frequency with a, e.g., 504 μm length arm (transmission line). More specifically, FIG. 6 shows a cross section of a branch line coupler 10" which includes a signal line 20 (with a width w_scan) located between two ground lines 22 (with a width ws_scan). A distance between the signal line 20 and each ground line 22 is s_scan. A crossing line 24 is provided under the signal line 20 and an inductance return line 26 is provided under the crossing line 24. The inductance return line 26 has a width w_ret. A grounded crossing line 28 connects to the two ground lines 22. In embodiments, the inductance ("l") and capacitance ("c") are switched at the same time and the same rate (e.g., percentage) to change the delay of the branch line coupler noting the computations of FIG. 6, e.g., taking into consideration w_scan, ws_scan, s_scan, w_ret, capacitance (high/low) and inductance (high/low), etc. Ideally to reconfigure the branch line coupler the following approximations are taken into consideration (which can be provided through calculations using, e.g., the embodiment shown in FIG. 9):

(i) %_change_l (Zo_A)=%_change_l (Zo_B): In this example: 96.6%~99.9%;

(ii) %_change_c (Zo_A)=%_change_c (Zo_B): In this example: 98.8%~101.1%;

(iii) 0.707*Zo_high (Zo_A)=Zo_high (Zo_B): In this example: 0.707*(53.5 Ohms)=37.8 Ohms~37.1 Ohms; and (iv) 0.707*Zo_low (Zo_A)=Zo_low (Zo_B): In this example: 0.707*(53.8 Ohms)=38 Ohms~37.2 Ohms.

Figure 7:
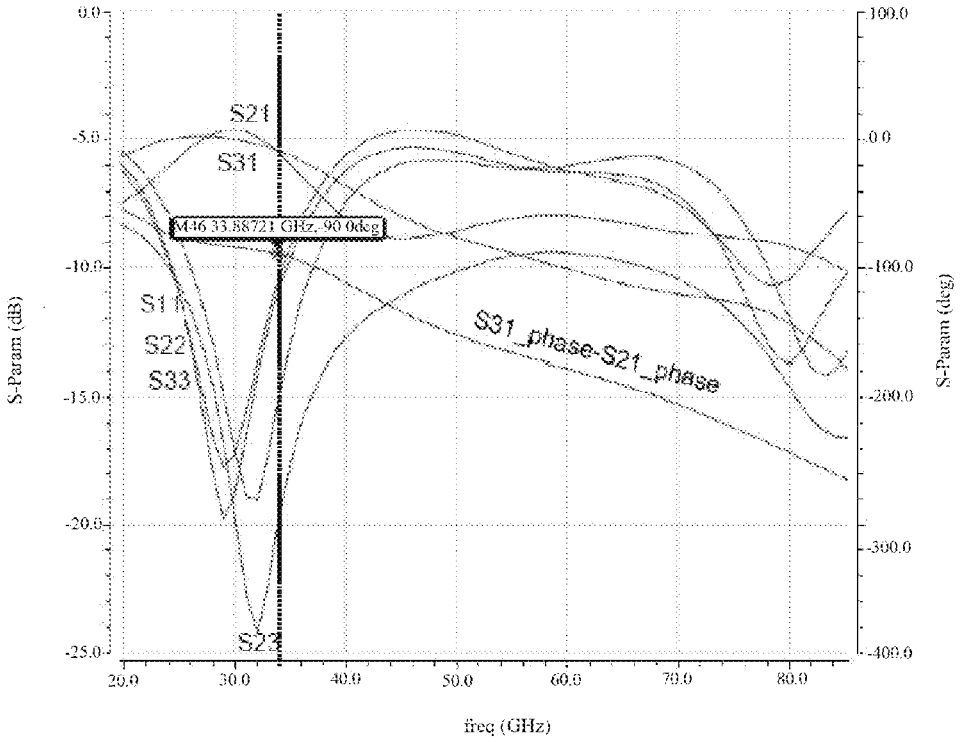
FIGS. 7 and 8 show performance graphs of simulated branch line couplers at different states.
Figure 8:
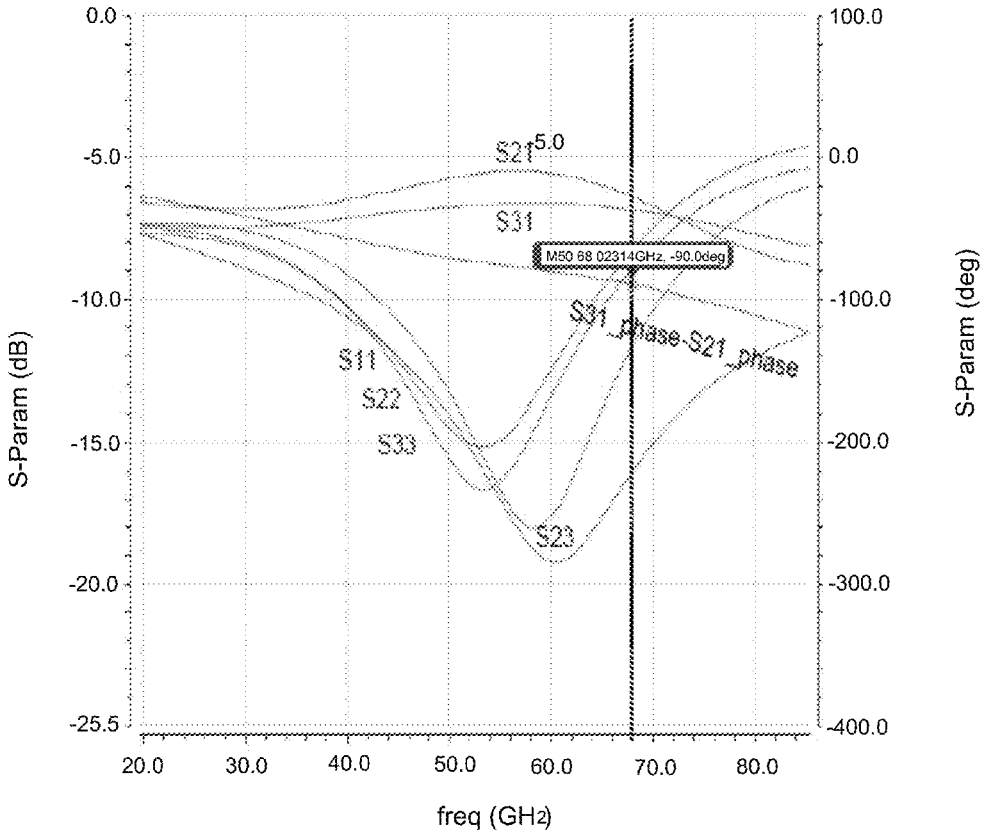

FIGS. 7 and 8 show performance graphs of simulated branch line couplers at different states, e.g., incremental states of the discrete sections of the phase shifters. In particular, FIG. 7 shows a simulation result of a 3-bit reconfigurable branch line in a first state, e.g., lowest frequency with all seven sections in a high state. As shown in this simulation result, the energy loss between port 2 and port 1 (line S21) is equal to the energy loss between port 3 and port 1 (line S31) at about 32 Ghz, with dB loss of about −5.5 dB. In comparison, FIG. 8 shows a simulation result of a 3-bit reconfigurable branch line in a last state, e.g., lowest delay state with all seven sections in a low state. In this state, the energy loss between port 2 and port 1 (line S21) is approximately equal to the energy loss between port 3 and port 1 (line S31) at about 68 Ghz, with dB loss of about −7.0 dB. Accordingly, FIGS. 7 and 8 show that the branch line coupler of the present invention can be used over a broad frequency range while still exhibiting an acceptably low dB loss and acceptable reflection and isolation performance at −90 degrees difference between phases of S31 and S21.

Figure 9:
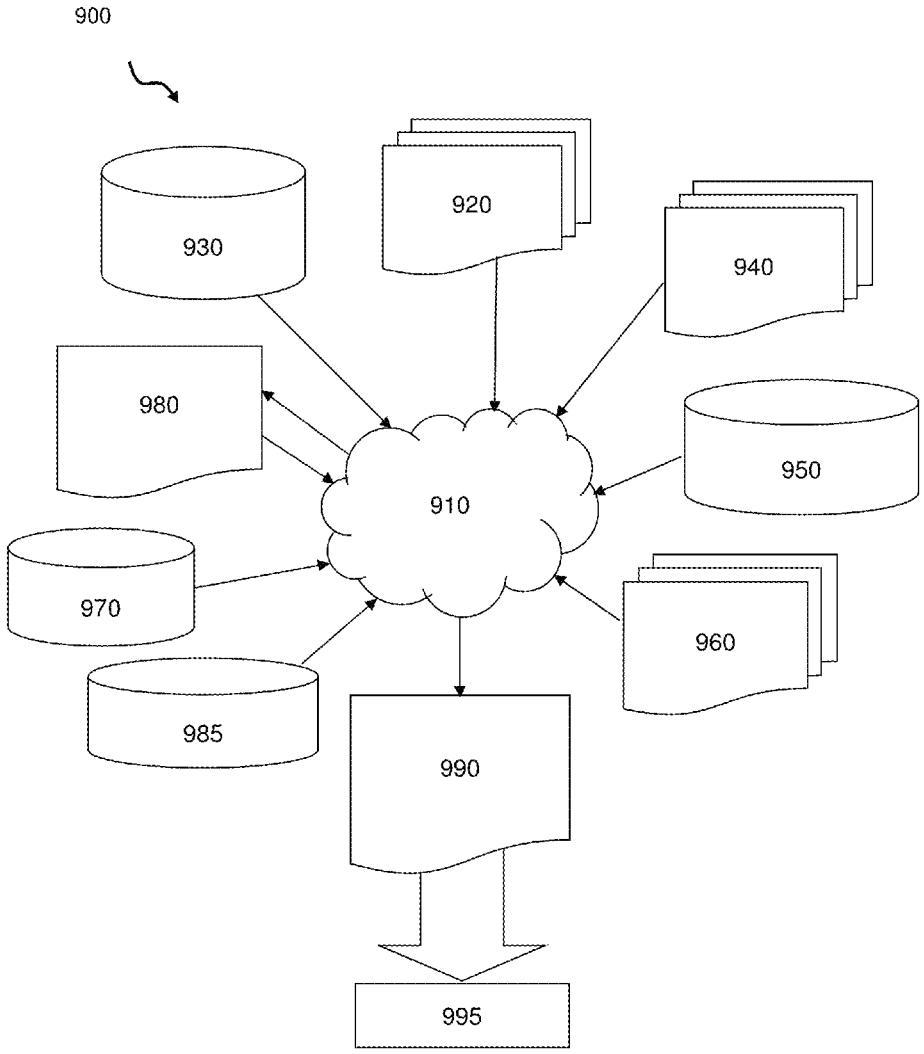
FIG. 9 is a flow diagram of a design process used in semiconductor design, manufacture, and/or test.

FIG. 9 is a flow diagram of a design process used in semiconductor design, manufacture, and/or test. FIG. 9 shows a block diagram of an exemplary design flow 900 used for example, in semiconductor IC logic design, simulation, test, layout, and manufacture. Design flow 900 includes processes, machines and/or mechanisms for processing design structures or devices to generate logically or otherwise functionally equivalent representations of the design structures and/or devices described above and shown in FIGS. 1-4 and 6. The design structures processed and/or generated by design flow 900 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 900 may vary depending on the type of representation being designed. For example, a design flow 900 for building an application specific IC (ASIC) may differ from a design flow 900 for designing a standard component or from a design flow 900 for instantiating the design into a programmable array, for example a programmable gate array (PGA) or a field programmable gate array (FPGA) offered by Altera® Inc. or Xilinx® Inc.

FIG. 9 illustrates multiple such design structures including an input design structure 920 that is preferably processed by a design process 910. Design structure 920 may be a logical simulation design structure generated and processed by design process 910 to produce a logically equivalent functional representation of a hardware device. Design structure 920 may also or alternatively comprise data and/or program instructions that when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 1-4 and 6. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 1-4 and 6 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990.

Design structure 990 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1-4 and 6. In one embodiment, design structure 990 may comprise a compiled, executable HDL simulation model that functionally simulates the devices shown in FIGS. 1-4 and 6.

Design structure 990 may also employ a data format used for the exchange of layout data of integrated circuits and/or symbolic data format (e.g. information stored in a GDSII (GDS2), GL1, OASIS, map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1-4 and 6. Design structure 990 may then proceed to a stage 995 where, for example, design structure 990: proceeds to tape-out, is released to manufacturing, is released to a mask house, is sent to another design house, is sent back to the customer, etc.

The method(s) as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A reconfigurable branch line coupler, comprising:

a plurality of transmission lines, each of which comprises a phase shifter; and an input port, which is split into two quadrature signals providing a second and third port between adjacent of the plurality of transmission lines, with a fourth port isolated from the input port at a center frequency;

wherein the phase shifters each have independently controllable inductance and independently controllable capacitance, and are structured to vary a phase shift without significantly affecting an original total characteristic impedance of the plurality of transmission lines.

2. The reconfigurable branch line coupler of claim 1, wherein each transmission line of the plurality of transmission lines is a quarter wavelength.

3. The reconfigurable branch line coupler of claim 1, wherein the phase shifters are structured to maintain constant characteristic impedance while changing delay of the plurality of transmission lines.

4. The reconfigurable branch line coupler of claim 1, wherein the phase shifters are structured to maintain a constant delay while varying characteristic impedance of each transmission line of the plurality of transmission lines.

5. The reconfigurable branch line coupler of claim 1, wherein the phase shifters have discrete sections structured to incrementally adjust frequency of the reconfigurable branch line coupler.

6. The reconfigurable branch line coupler of claim 5, wherein the discrete sections are structured to incrementally adjust frequency of the branch line coupler between various operating frequencies.

7. The reconfigurable branch line coupler of claim 5, wherein each of the discrete sections has two capacitance states and two inductance states, resulting in at least four permutations: (i) capacitance high, inductance high; (ii) capacitance high, inductance low; (iii) capacitance low, inductance high; and (iv) capacitance low, inductance low.

8. The reconfigurable branch line coupler of claim 5, wherein each of the discrete sections provide frequency change between f_high and f_low.

9. The reconfigurable branch line coupler of claim 1, wherein the second port and the fourth port are swapped ports.

10. The reconfigurable branch line coupler of claim 1 is a switch.

11. The reconfigurable branch line coupler of claim 1, wherein the branch line coupler is reconfigured by adjusting characteristic impedance of the phase shifter on transmission lines by a factor of sqrt(2) times an original characteristic impedance of the transmission lines.

12. A reconfigurable branch line coupler, comprising:

a plurality of transmission lines coupled to one another, the plurality of transmission lines comprising:

a first transmission line having a characteristic impedance of Zo_B;

a second transmission line having a characteristic impedance of Zo_A;

a third transmission line having a characteristic impedance of Zo_B; and a fourth transmission line having characteristic impedance of Zo_A; and a phase shifter provided in each of the plurality of transmission lines, the phase shifter in each of the plurality of transmission lines being structured to maintain a constant original total characteristic impedance of Zo_B and Zo_A while changing a frequency in each of the plurality of transmission lines.

13. The reconfigurable branch line coupler of claim 12, wherein the phase shifter provided in each of the plurality of transmission lines comprises discrete sections with controllable inductance and controllable capacitance to incrementally adjust frequency of the reconfigurable branch line coupler, wherein each of the discrete sections has two capacitance states and two inductance states, resulting in at least four permutations: (i) capacitance high, inductance high; (ii) capacitance high, inductance low; (iii) capacitance low, inductance high; and (iv) capacitance low, inductance low.

14. The reconfigurable branch line coupler of claim 13, wherein each of the discrete sections provide frequency change between f_high and f_low.

15. The reconfigurable branch line coupler of claim 12, wherein the branch line coupler is reconfigured by adjusting characteristic impedance of the phase shifter on transmission lines by a factor of sqrt(2) times an original characteristic impedance of the transmission lines.

16. The reconfigurable branch line coupler of claim 12 has swappable ports.

17. The reconfigurable branch line coupler of claim 12 is a switch.

18. A method of reconfiguring a branch line coupler, comprising:

determining an initial characteristic impedance Zo_A and Zo_B for a specific frequency for each transmission line of the branch line coupler; and adjusting capacitance, inductance, at a same time and same rate, taking into consideration w_scan, ws_scan, s_scan, w_ret, capacitance (high/low) and inductance (high/low), with the following approximations:

(i) %_change_l(Zo_A)=%_change_l(Zo_B);

(ii) %_change_c(Zo_A)=%_change_c(Zo_B);

(iii) 0.707*Zo_high(Zo_A)=Zo_high(Zo_B); and (iv) 0.707*Zo_low(Zo_A)=Zo_low(Zo_B).

* * * * *